US010016054B1

(12) United States Patent
Parasher

(10) Patent No.: US 10,016,054 B1
(45) Date of Patent: Jul. 10, 2018

(54) BROOM AND DUSTPAN

(71) Applicant: Bharti Parasher, Hamilton, NJ (US)

(72) Inventor: Bharti Parasher, Hamilton, NJ (US)

( * ) Notice: Subject to any disclaimer, the term of this patent is extended or adjusted under 35 U.S.C. 154(b) by 0 days.

(21) Appl. No.: 15/646,241

(22) Filed: Jul. 11, 2017

(51) Int. Cl.

| | |
|---|---|
| ***A47L 13/52*** | (2006.01) |
| ***A46B 15/00*** | (2006.01) |
| ***A46B 5/00*** | (2006.01) |
| ***A47L 13/16*** | (2006.01) |
| ***A47L 13/51*** | (2006.01) |

(52) U.S. Cl.
CPC ..... *A46B 15/0055* (2013.01); *A46B 5/0095* (2013.01); *A47L 13/16* (2013.01); *A47L 13/51* (2013.01); *A47L 13/52* (2013.01); *A46B 2200/302* (2013.01)

(58) Field of Classification Search
CPC ..... A47L 13/51; A47L 13/52
See application file for complete search history.

(56) References Cited

U.S. PATENT DOCUMENTS

| | | | | |
|---|---|---|---|---|
| 2,924,841 | A | 2/1960 | Seibert | |
| 3,361,507 | A * | 1/1968 | O'Neil | A47K 17/00 206/361 |
| 5,425,153 | A * | 6/1995 | Vosbikian | A47L 13/52 15/257.2 |
| D466,262 | S | 11/2002 | Chemtob | |
| 6,892,419 | B1 | 5/2005 | Duprey | |
| 6,971,138 | B2 | 12/2005 | Berti | |
| 2005/0273966 | A1 | 12/2005 | Dillon | |
| 2007/0089259 | A1 * | 4/2007 | Jones | A46B 15/00 15/257.2 |
| 2015/0059111 | A1 | 3/2015 | Gibis | |

* cited by examiner

*Primary Examiner* — Randall Chin
(74) *Attorney, Agent, or Firm* — Kyle A. Fletcher, Esq.

(57) ABSTRACT

The broom and dustpan comprises a broom with a detachable dustpan. The dustpan pivots at the point where the pan couples to the dustpan handle. The dustpan provides a long handle that clips to the broom handle. The combination of a pivoting head and a long handle allows the dustpan to be used by a person standing upright. The dustpan provide a scouring surface around the front outside edge of the pan. The broom provides an auxiliary cover that can be used for storage wipes. The broom provides insertion points for a cloth that may cover the broom bristles to convert the broom into a dust mop.

20 Claims, 5 Drawing Sheets

BROOM AND DUSTPAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of household tools, more specifically, a broom and dustpan.

SUMMARY OF INVENTION

The broom and dustpan comprises a broom with a detachable dustpan. The dustpan pivots at the point where the pan couples to the dustpan handle. The dustpan provides a long handle that clips to the broom handle. The combination of a pivoting head and a long handle allows the dustpan to be used by a person standing upright. The dustpan provide a scouring surface around the front outside edge of the pan. The broom provides an auxiliary cover that can be used for storage wipes. The broom provides insertion points for a cloth that may cover the broom bristles to convert the broom into a dust mop.

An object of the invention is to provide a broom with a detachable dustpan.

Another object of the invention is to provide the dustpan with a pivot point between the pan and the handle.

A further object of the invention is to provide insertion points for holding a microfiber cloth over the bristle of the broom.

Yet another object of the invention is to provide a scouring surface on an outer edge of the dustpan.

These together with additional objects, features and advantages of the broom and dustpan will be readily apparent to those of ordinary skill in the art upon reading the following detailed description of the presently preferred, but nonetheless illustrative, embodiments when taken in conjunction with the accompanying drawings.

In this respect, before explaining the current embodiments of the broom and dustpan in detail, it is to be understood that the broom and dustpan is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the broom and dustpan.

It is therefore important that the claims be regarded as including such equivalent construction insofar as they do not depart from the spirit and scope of the broom and dustpan. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
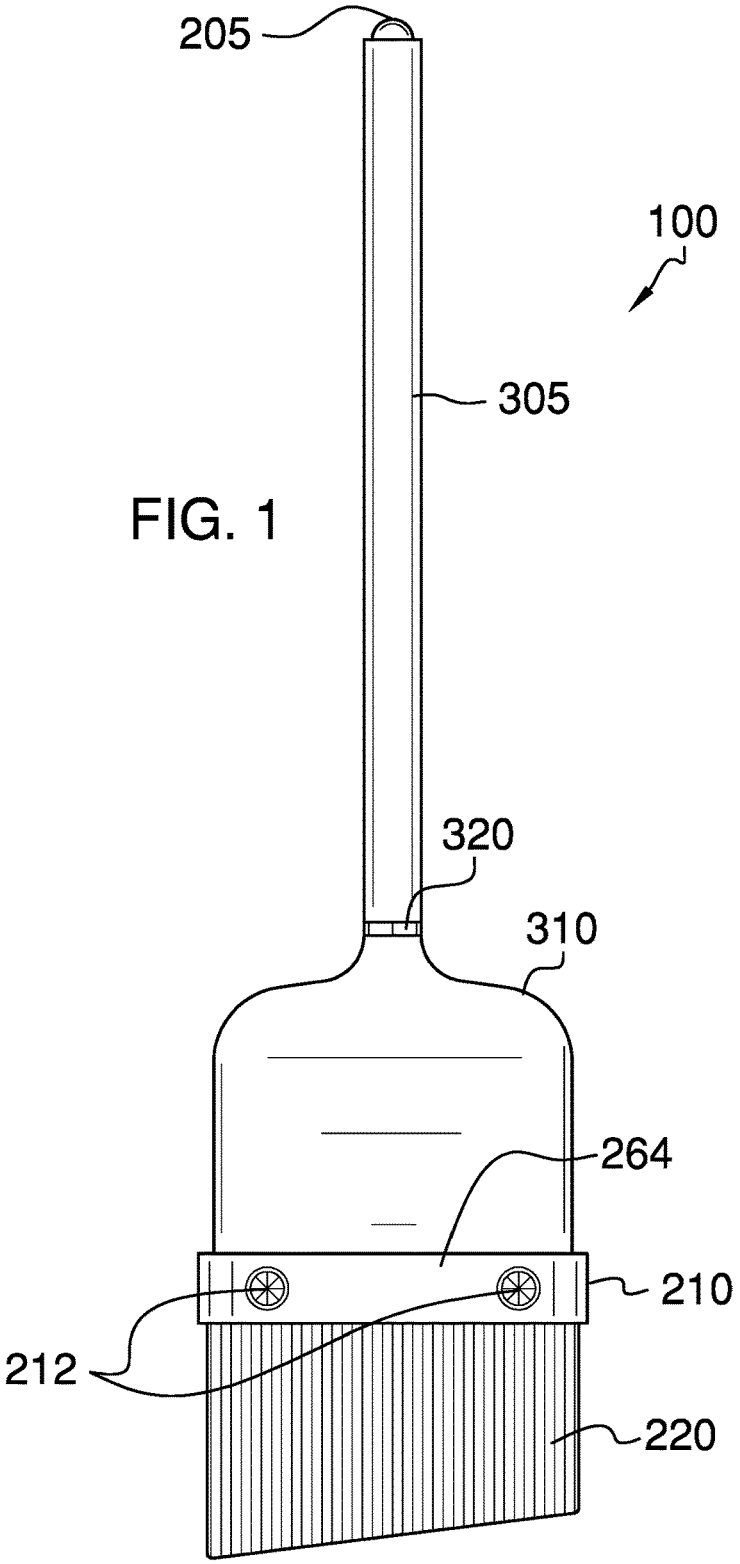
FIG. 1 is a front view of an embodiment of the disclosure.
Figure 2:
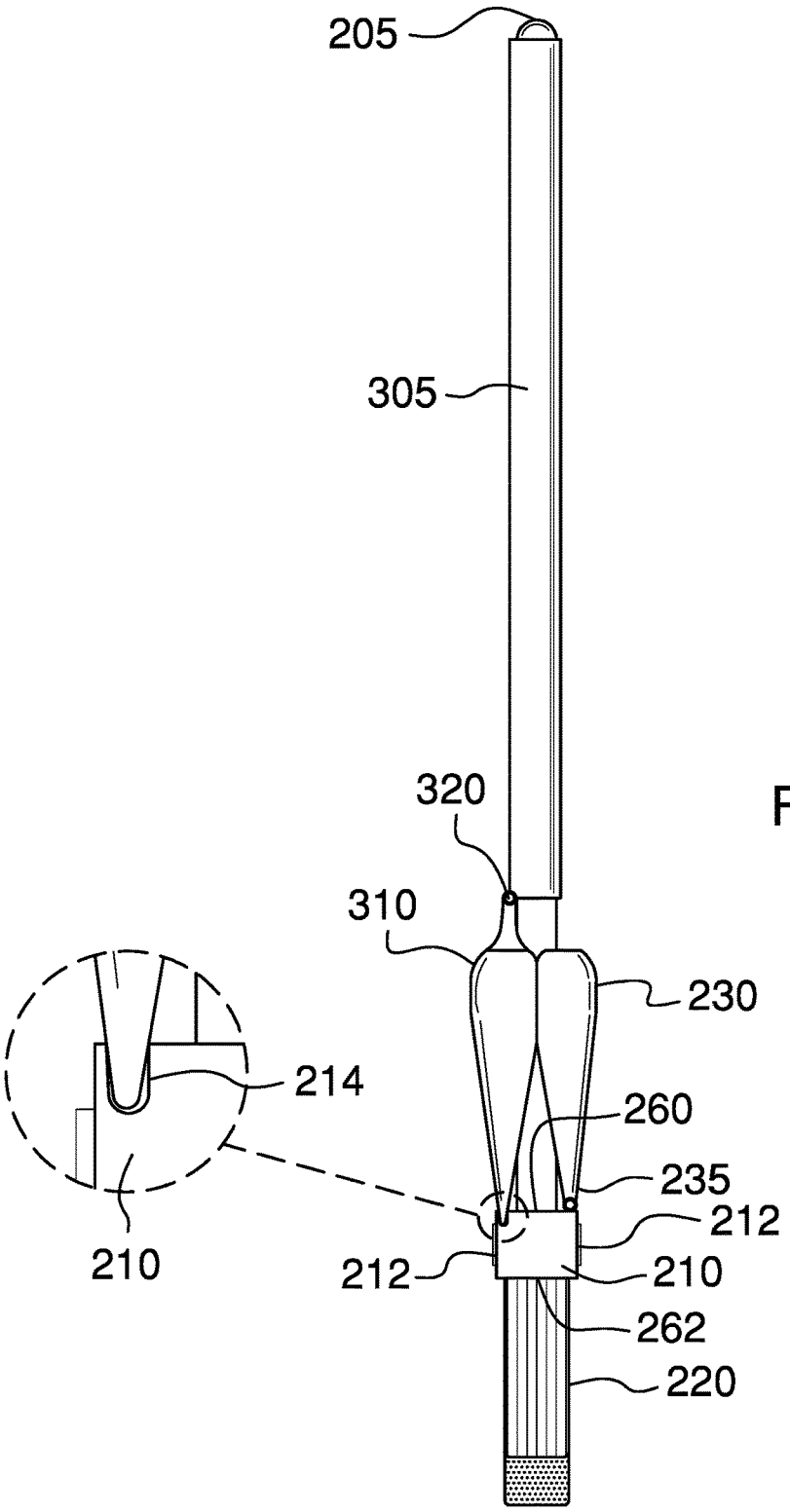
FIG. 2 is a side view of an embodiment of the disclosure.
Figure 3:
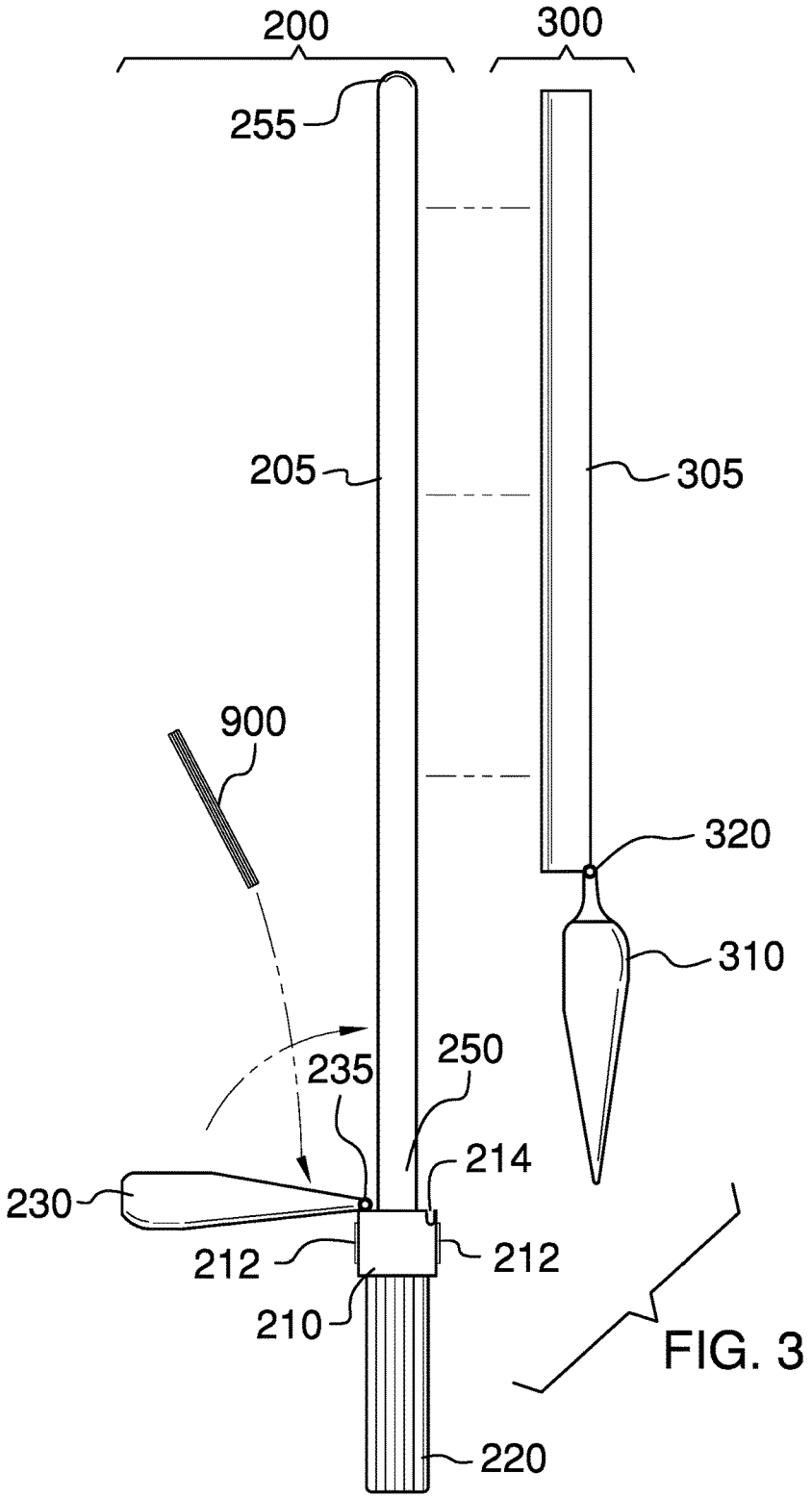
FIG. 3 is an exploded view of an embodiment of the disclosure showing the dustpan separated from the broom.
Figure 4:
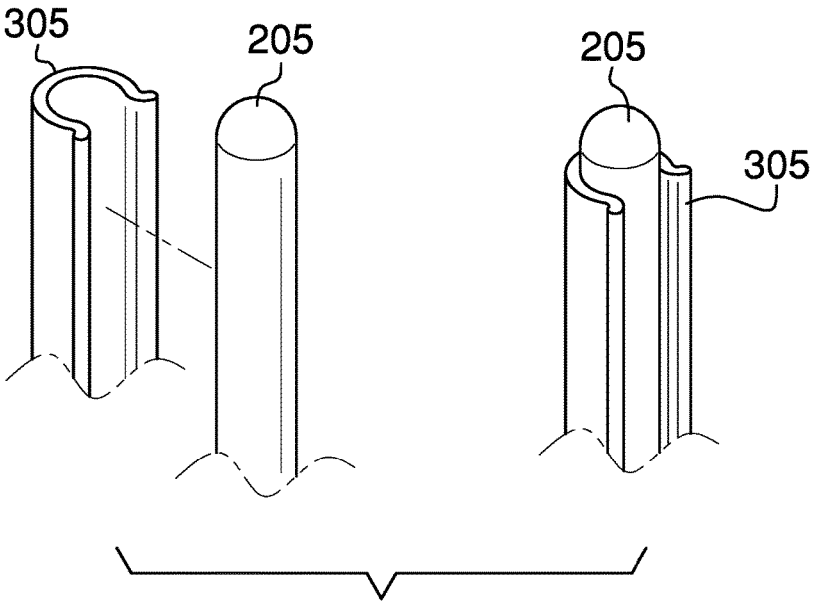
FIG. 4 is a detailed perspective view of an embodiment of the disclosure showing the handles of the broom and the dustpan.
Figure 5:
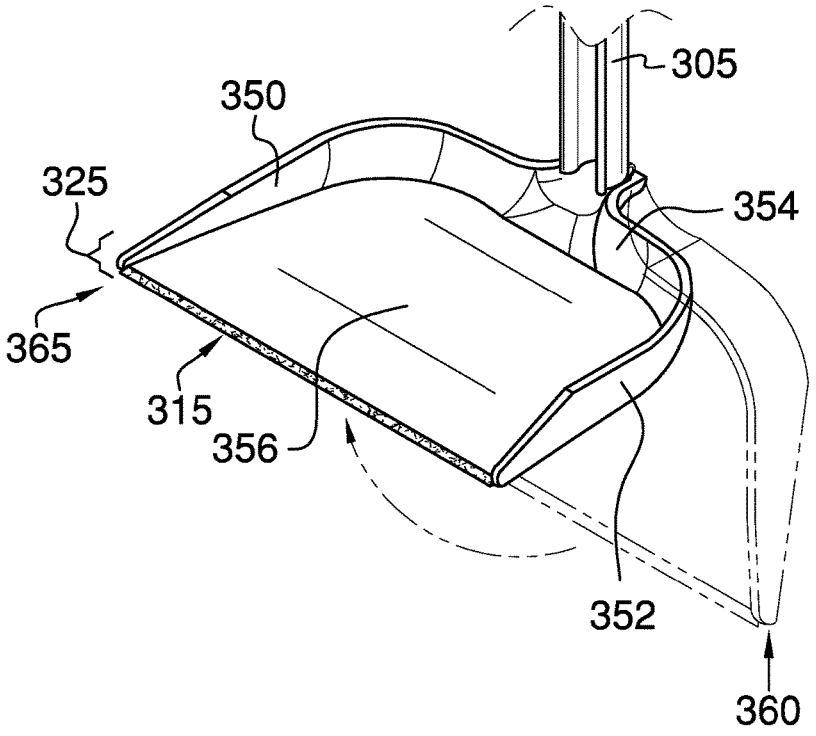
FIG. 5 is a detail view of an embodiment of the disclosure showing the pivoting action of the dustpan.
Figure 6:
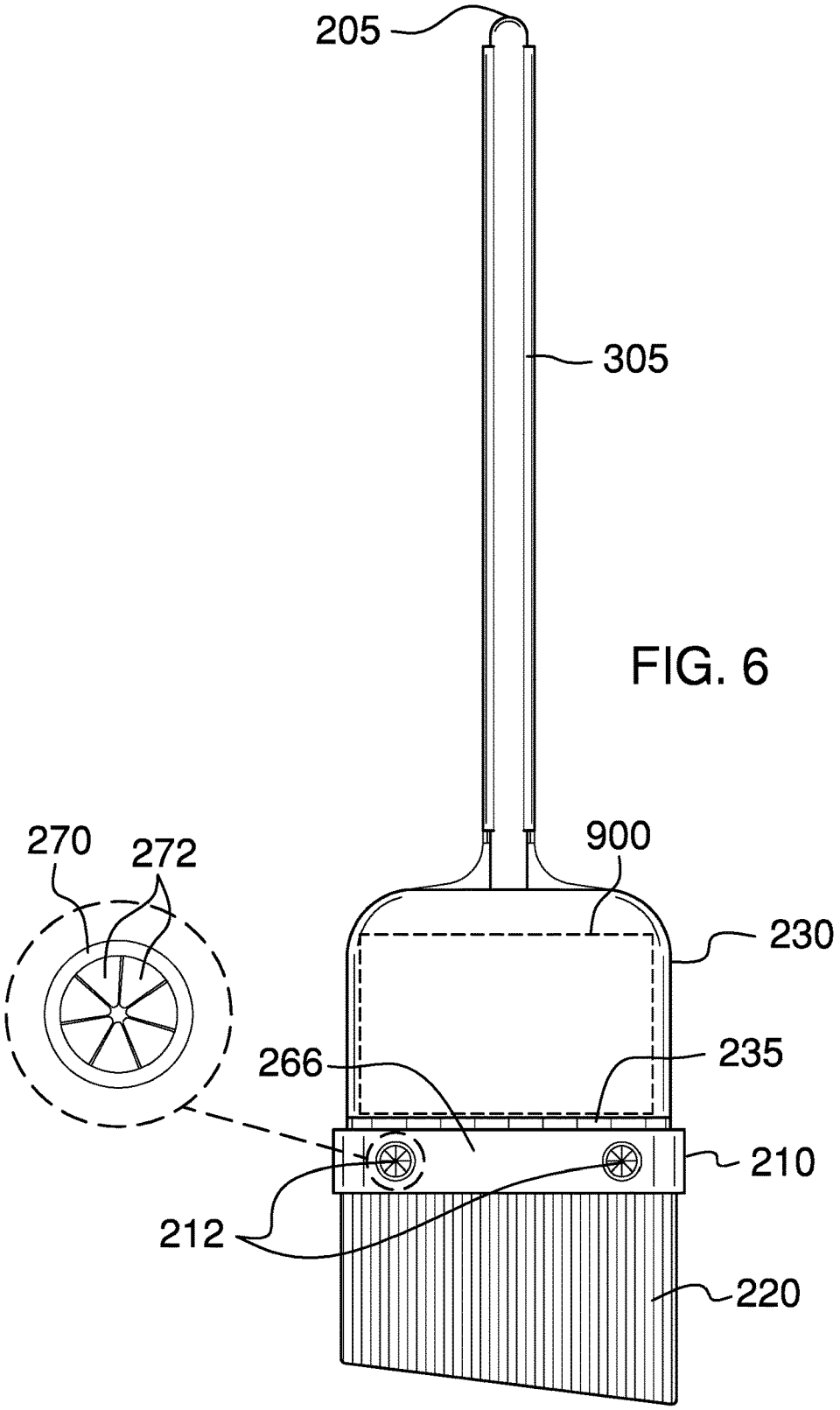
FIG. 6 is a rear view of an embodiment of the disclosure.

Detailed reference will now be made to a first potential embodiment of the disclosure, which is illustrated in FIGS. 1 through 6.

The broom and dustpan 100 (hereinafter invention) comprises a broom 200 and a dustpan attachment 300. The dustpan attachment 300 is detachable from the broom 200. A dustpan 310 portion of the dustpan attachment 300 may pivot with respect to a dustpan handle 305 to make it easier to use without bending over. The dustpan 310 may comprise a scouring surface 315. The broom 200 may comprise an auxiliary cover 230 for storage. The broom 200 may comprise a plurality of cloth insertion points 212 for attaching a microfiber cloth (not illustrated in the figures) to the broom 200.

The broom 200 comprises a broom handle 205, a broom head 210 and a plurality of bristles 220. The broom handle 205 may be a round shaft having a first end 250 and a second end 255. The first end 250 of the broom handle 205 couples to the broom head 210. As non-limiting examples, the broom handle 205 may be fabricated from plastic, metal, wood, another rigid material, or a combination thereof. In some embodiments, the first end 250 of the broom handle 205 may detachably couple to the broom head 210. As a non-limiting example, the broom head 210 may comprise a female threaded receptacle and the first end 250 of the broom handle 205 may comprise a male threaded shaft.

The broom head 210 has a broom head top 260, a broom head bottom 262, a broom head front 264, and a broom head rear 266. The broom handle 205 couples to the center of the broom head top 260. A retention notch 214 may run along a long edge of the broom head top 260. The retention notch 214 may accept a lip 325 of the dustpan 310 when the dustpan attachment 300 is attached to the broom 200 and by doing so the retention notch 214 may prevent the dustpan 310 from pivoting during storage of the invention 100.

The plurality of bristles 220 couple to the broom head bottom 262 and extend downwards from the broom head bottom 262.

A cover hinge 235 may couple to an edge of the broom head top 260 opposite the retention notch 214. The cover hinge 235 pivotally couples the auxiliary cover 230 to the broom head 210. The auxiliary cover 230 may comprise a storage location for one or more wipes 900 or for the microfiber clothes.

The broom head front 264 and the broom head rear 266 may comprise the plurality of cloth insertion points 212. In a preferred embodiment, there are four of the plurality of cloth insertion points 212—two located on the broom head front 264 and two located on the broom head rear 266. Each of the plurality of cloth insertion points 212 are located close to a vertical edge of the broom head front 264 or the broom head rear 266. Here 'close' is defined to mean less than 25% of the total distance horizontally across the broom head front 264 or the broom head rear 266.

Each of the plurality of cloth insertion points 212 may comprise a circular orifice 270 with a plurality of flexible tabs 272 extending from a periphery of the circular orifice 270 towards the center of the circular orifice 270. The microfiber cloth, or similar cloth, may be retained by plurality of cloth insertion points 212 by pressing a corner of the cloth into the circular orifice 270 with a finger at each of the plurality of cloth insertion points 212. The plurality of flexible tabs 272 will prevent the microfiber cloth from pulling back out of the circular orifice 270. Using the plurality of cloth insertion points 212, the microfiber cloth may be used to cover the plurality of bristles 220 of the broom 200 thus transforming the broom 200 into a dust mop.

The dustpan attachment 300 comprises the dustpan handle 305, the dustpan 310, a dustpan hinge 320 and the scouring surface 315. The dustpan handle 305 has a concave cross-section allowing it to snap onto the broom handle 205. As non-limiting examples, the dustpan handle 305 may have a C-shaped or horseshoe shaped cross-section. In some embodiments, the length of the dustpan handle 305 may be such that when the dustpan attachment 300 is snapped onto the broom handle 205, the dustpan handle 305 reaches substantially to the top of the broom 200. Here 'substantially to the top' is defined to mean within 1 inch of the top.

The dustpan 310 comprises a dustpan left side 350, a dustpan right side 352, a dustpan rear side 354, and a dustpan bottom panel 356. The dustpan bottom panel 356 is a thin, flat collection point for dust and debris that is swept into the dustpan 310. The lip 325 on the front of the dustpan 310 is a narrowing of the dustpan bottom panel 356 to make it easier to sweep dust and debris into the dustpan 310. The dustpan left side 350, the dustpan right side 352, and the dustpan rear side 354 prevent dust and debris from falling out of the dustpan 310.

The dustpan hinge 320 pivotally couples the dustpan rear side 354 to the dustpan handle 305. The dustpan hinge 320 allows the dustpan 310 to pivot through an angle of 90 degrees. At a 0 degree pivot angle 360, the dustpan bottom panel 356 is in line with the dustpan handle 305. The 0 degree pivot angle 360 is the position used when the dustpan attachment 300 is snapped onto the broom 200. At a 90 degree pivot angle 365, the dustpan bottom panel 356 may be placed against and parallel to the floor while the dustpan handle 305 extends upwards, making the dustpan attachment 300 easier to use while standing. In some embodiments, the dustpan hinge 320 may comprise a pivot lock (not illustrated in the figures) which temporarily prevents the dustpan 310 from pivoting relative to the dustpan handle 305. As a non-limiting example, the pivot lock may be a detent. The pivot lock may prevent pivoting out of the 0 degree pivot angle 360, out of the 90 degree pivot angle 365, or both. A user may force the dustpan 310 to pivot by increasing the pressure used to pivot the dustpan 310 until the pivot lock releases.

The scouring surface 315 may be located on the underside of the lip 325. The scouring surface 315 may comprise a roughened area of the underside of the dustpan 310 or it may comprise a different material applied to the underside of the dustpan bottom panel 356. As a non-limiting example, the scouring surface 315 may be a thin, plastic mesh. The scouring surface 315 may be used remove dried-on grime by rubbing the scouring surface 315 repeatedly over the grime. In some embodiments, the scouring surface 315 may extend up onto the outside surface of the dustpan left side 350 and the dustpan right side 352.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A broom and dustpan comprising:

a broom and a dustpan attachment;

wherein the dustpan attachment is detachable from the broom;

wherein a dustpan portion of the dustpan attachment pivots with respect to a dustpan handle;

wherein the dustpan comprises a scouring surface;

wherein the broom comprises an auxiliary cover for storage;

wherein the broom comprises a plurality of cloth insertion points for attaching a cloth to the broom.

2. The broom and dustpan according to claim 1 wherein the broom comprises a broom handle, a broom head and a plurality of bristles;

wherein the broom handle is a round shaft having a first end and a second end;

wherein the first end of the broom handle couples to the broom head.

3. The broom and dustpan according to claim 2 wherein the first end of the broom handle detachably couples to the broom head.

4. The broom and dustpan according to claim 2
wherein the broom head has a broom head top, a broom head bottom, a broom head front, and a broom head rear;
wherein the broom handle couples to the center of the broom head top;
wherein a retention notch runs along a long edge of the broom head top;
wherein the retention notch accepts a lip of the dustpan when the dustpan attachment is attached to the broom;
wherein the retention notch prevents the dustpan from pivoting during storage of the broom and dustpan.

5. The broom and dustpan according to claim 4
wherein the plurality of bristles couple to the broom head bottom and extend downwards from the broom head bottom.

6. The broom and dustpan according to claim 5
wherein a cover hinge couples to an edge of the broom head top opposite the retention notch;
wherein the cover hinge pivotally couples the auxiliary cover to the broom head;
wherein the auxiliary cover comprises a storage location.

7. The broom and dustpan according to claim 6
wherein the broom head front and the broom head rear comprise the plurality of cloth insertion points.

8. The broom and dustpan according to claim 7
wherein there are two of the plurality of cloth insertion points located on the broom head front;
wherein there are two of the plurality of cloth insertion points located on the broom head rear.

9. The broom and dustpan according to claim 8
wherein each of the plurality of cloth insertion points are located close to a vertical edge of the broom head front or the broom head rear.

10. The broom and dustpan according to claim 9
wherein each of the plurality of cloth insertion points comprises a circular orifice with a plurality of flexible tabs extending from a periphery of the circular orifice towards the center of the circular orifice;
wherein the cloth is retained by the plurality of cloth insertion points by pressing a corner of the cloth into the circular orifice with a finger at each of the plurality of cloth insertion points;
wherein the plurality of flexible tabs will prevent the cloth from pulling back out of the circular orifice;
wherein the plurality of cloth insertion points hold the cloth in a position to cover the plurality of bristles of the broom thus transforming the broom into a dust mop.

11. The broom and dustpan according to claim 10
wherein the dustpan attachment comprises the dustpan handle, the dustpan, a dustpan hinge and the scouring surface;
wherein the dustpan handle has a concave cross-section allowing it to snap onto the broom handle;
wherein the length of the dustpan handle is such that when the dustpan attachment is snapped onto the broom handle, the dustpan handle reaches substantially to the top of the broom.

12. The broom and dustpan according to claim 11
wherein the dustpan handle has a C-shaped or horseshoe shaped cross-section.

13. The broom and dustpan according to claim 11
wherein the dustpan comprises a dustpan left side, a dustpan right side, a dustpan rear side, and a dustpan bottom panel;
wherein the dustpan bottom panel is a flat collection point for dust and debris that is swept into the dustpan;
wherein the lip on the front of the dustpan is a narrowing of the dustpan bottom panel to make it easier to sweep dust and debris into the dustpan;
wherein the dustpan left side, the dustpan right side, and the dustpan rear side prevent dust and debris from falling out of the dustpan.

14. The broom and dustpan according to claim 13
wherein the dustpan hinge pivotally couples the dustpan rear side to the dustpan handle;
wherein the dustpan hinge allows the dustpan to pivot through an angle of 90 degrees;
wherein at a 0 degree pivot angle, the dustpan bottom panel is in line with the dustpan handle;
wherein the 0 degree pivot angle is the position used when the dustpan attachment is snapped onto the broom;
wherein at a 90 degree pivot angle, the dustpan bottom panel is placed against and parallel to the floor while the dustpan handle extends upwards, making the dustpan attachment easier to use while standing.

15. The broom and dustpan according to claim 14
wherein the dustpan hinge comprises a pivot lock which temporarily prevents the dustpan from pivoting relative to the dustpan handle.

16. The broom and dustpan according to claim 15
wherein the pivot lock is a detent.

17. The broom and dustpan according to claim 15
wherein the pivot lock prevents pivoting out of the 0 degree pivot angle, out of the 90 degree pivot angle, or both;
wherein the dustpan is adapted to pivot when a user increases the pressure until the pivot lock releases.

18. The broom and dustpan according to claim 14
wherein the scouring surface is located on the underside of the lip;
wherein the scouring surface comprises a roughened area of the underside of the dustpan or a different material applied to the underside of the dustpan bottom panel;
wherein the scouring surface is used remove dried-on grime by rubbing the scouring surface repeatedly over the grime.

19. The broom and dustpan according to claim 18
wherein the scouring surface is a plastic mesh.

20. The broom and dustpan according to claim 18
wherein the scouring surface extends up onto the outside surface of the dustpan left side and the dustpan right side.

* * * * *